US007451960B2

(12) United States Patent
Kirchner et al.

(10) Patent No.: US 7,451,960 B2
(45) Date of Patent: Nov. 18, 2008

(54) SUPPORT APPARATUS

(75) Inventors: Uwe Kirchner, Marloffstein (DE); Wolfgang Bertleff, Erlangen (DE)

(73) Assignee: Lukas Hydraulik GmbH, Erlangen (DE)

( * ) Notice: Subject to any disclaimer, the term of this patent is extended or adjusted under 35 U.S.C. 154(b) by 0 days.

(21) Appl. No.: 10/894,926

(22) Filed: Jul. 20, 2004

(65) Prior Publication Data

US 2005/0109995 A1 May 26, 2005

(30) Foreign Application Priority Data

Aug. 27, 2003 (DE) ..... 103 39 814

(51) Int. Cl.
*B65H 3/08* (2006.01)

(52) U.S. Cl. ..... 254/1; 254/134; 254/93 H; 269/249

(58) Field of Classification Search ..... 254/1, 254/134, 93 H, 108, 119; 269/143, 249
See application file for complete search history.

(56) References Cited

U.S. PATENT DOCUMENTS 1,237,525 A * 8/1917 Keator ..... 52/704
4,962,918 A * 10/1990 Yang ..... 269/156
6,431,522 B1 9/2002 Cutrell, Sr. et al.
6,474,632 B1 * 11/2002 Liou ..... 269/6
2004/0232608 A1 * 11/2004 Wong ..... 269/249

FOREIGN PATENT DOCUMENTS

| | | |
|---|---|---|
| CH | 97983 | 8/1921 |
| DE | 92 13 407.6 | 2/1993 |
| DE | G 92 13 407.6 | 2/1993 |
| DE | 295 11 044 | 11/1995 |
| DE | 295 11.044 U1 | 11/1995 |
| DE | 298 19 861 U1 | 5/1999 |
| DE | 198 13 404 A1 | 9/1999 |
| SE | 97983 | 8/1921 |

* cited by examiner

*Primary Examiner*—Lee D Wilson
(74) *Attorney, Agent, or Firm*—Merchant & Gould P.C.

(57) ABSTRACT

The invention relates to an apparatus for supporting a tool on an object. The apparatus has a frame and ways on the frame for fixing the apparatus to the object. The tool is attached to the apparatus and the latter supports itself against the object In addition, the frame displays an upper and a lower support claw that are effective even in an inclined disposition with respect to the object. The frame including the upper and lower support claws further forms a C-shape. Moreover, the upper as well as lower support claws are designed such tat the holding effect during loading of the apparatus arises through the canting of the two support claws with respect to a portion of the object located between the two support claws.

14 Claims, 5 Drawing Sheets

SUPPORT APPARATUS

BACKGROUND OF THE INVENTION

1. Field of the Invention

The present invention relates to a support apparatus according to the preamble of claim 1.

2. Description of the Prior Art

Known from U.S. Pat. No. 6,431,522 B 1 is a support apparatus belonging to the class. The frame of this known support apparatus includes means for fixing the same to an object, e.g. to a door sill of a vehicle, said means being in the form of a lower and an upper support plate, between which a portion of the object, e.g. the door sill of the vehicle, is clamped in the manner of a vice by means of a hydraulic ram. This support apparatus has variable applicability, but through the necessary use of a hydraulic ram is very complex in a device-technology sense.

Known from DE 198 13 404 A 1 is a support bracket for supporting and shortening the support length of a spreading device. This support bracket is intended for application in the region of the transition between the door beam and the door sill of a vehicle. It therefore has the disadvantage that it can be used only at this predetermined location on the vehicle. If this location becomes greatly distorted due to an accident, the support bracket can no longer be used.

SUMMARY OF THE INVENTION

The object of the present invention consists in making available a novel support apparatus that possesses a simple device-technology structure, and at the same time is variably applicable.

The object in question is achieved in the support device according to the class through the following:

a) The frame displays an upper as well as lower claw that are effective even in an inclined disposition with respect to the object.
b) The frame, including the upper and lower support claws, has a C-shape.
c) The upper as well as lower support claws are designed such that the holding effect during loading of the support apparatus arises through the canting of the two support claws with respect to a portion of the object located between the two support claws.

Through the two support claws, by which the support apparatus becomes installed in a canted position with respect to the object, e.g. a door sill, a self-holding effect during loading, i.e. supporting of the rescue tool, is achieved, which effect holds the support apparatus in position on the object. This self-holding effect advantageously strengthens with increasing load on the rescue tool. By virtue of the C-shape, the support apparatus can be attached to any position on the door sill. Thus, with respect to the location of use the support apparatus is variably applicable, and at the same time, due to the self-holding effect, additional structural measures, as for example the use of a hydraulic cylinder, can be eliminated.

The support claw usefully displays at least one narrow, elongated and/or edge-shaped bearing surface. Through this means is achieved, first, a rolling effect in order to ensure the canting, and second, an appropriate holding effect during canting.

The holding effect is increased still further through the fact that the support claw displays toothing. At the same time, a particular holding effect transversely to the main load direction is achieved. A lateral slipping from the sill is thereby prevented.

A further embodiment of the present invention consists in that the support claw in each case displays bearing surfaces bilaterally with respect to the support apparatus, in particular arranged in a so-called mirror-symmetrical manner. This results in the advantage that the support apparatus can be used bilaterally.

Appropriately, the support claw is designed as an angled rail, the mouth of which opens in the direction of the opposing support claw.

Appropriately, the above embodiments can relate to only one of the two support claws to be used, but preferably relate to both the lower and the upper support claw.

Through the fact that the upper support claw displays a bearing surface, especially self-centering, for the tool, the tool can be properly placed onto the support apparatus.

This bearing region is formed, for example, through an additional cross strut, e.g. in the form of a pipe or a bar, which preferably runs parallel to the upper support claw and which the attachment part of the tool can engage.

Appropriately, the attachment part of the tool is formed in a manner corresponding to the cross strut, e.g. with a recess or a gradation.

In order to increase the holding effect of the attachment part on the bearing region of the support apparatus, the bearing region displays a structuring, in particular individual grooves. The effect of the grooves is that, in particular, a lateral slipping (i.e. occurring transversely to the main loading direction) of the rescue tool is prevented.

The cross strut and the upper support claw are connected to each other via a common end plate, whereby a maximum stability of the support apparatus in the bearing region results.

According to a further embodiment of the present invention, the spacing between the two support claws is adjustable, i.e. the C-shape has a variable opening width. This is advantageous insofar as the user can temporarily fix the support apparatus through adjustment of the opening width, before the rescue tool is placed on. Also, a desired reduction of the inclination angle of the support apparatus on the object can be carried out. Moreover, the variable opening width has the consequence that vehicles having different sill heights can be grasped with a single support apparatus.

Appropriately, to ensure the adjustability of the opening width the frame is divided into a first frame part and a second frame part, the two frame parts being slidable, yet fixable, relative to each other.

The fixing of the two frame parts to each other can be designed in a non-positive manner, for example through a fixing screw, and/or positively through a stop bolt, both of which engage corresponding recesses or holes.

Appropriately, the tool displays an end piece (e.g. a prism-shaped end piece) adapted to the shape of the bearing region. The adapted end piece is appropriately embodied such that a rotational movement of the tool around the bearing region is simplified. In contrast, the risk of a lateral slipping, i.e. occurring transversely to the main load direction, is intended to be avoided.

BRIEF DESCRIPTION OF THE DRAWINGS

In the following, an embodiment of the invention is explained in detail with the aid of the drawn figures. For the sake of simplicity, recurring features are provided with reference numerals only once. In the drawings.

DETAILED DESCRIPTION OF THE INVENTION

Figure 1:
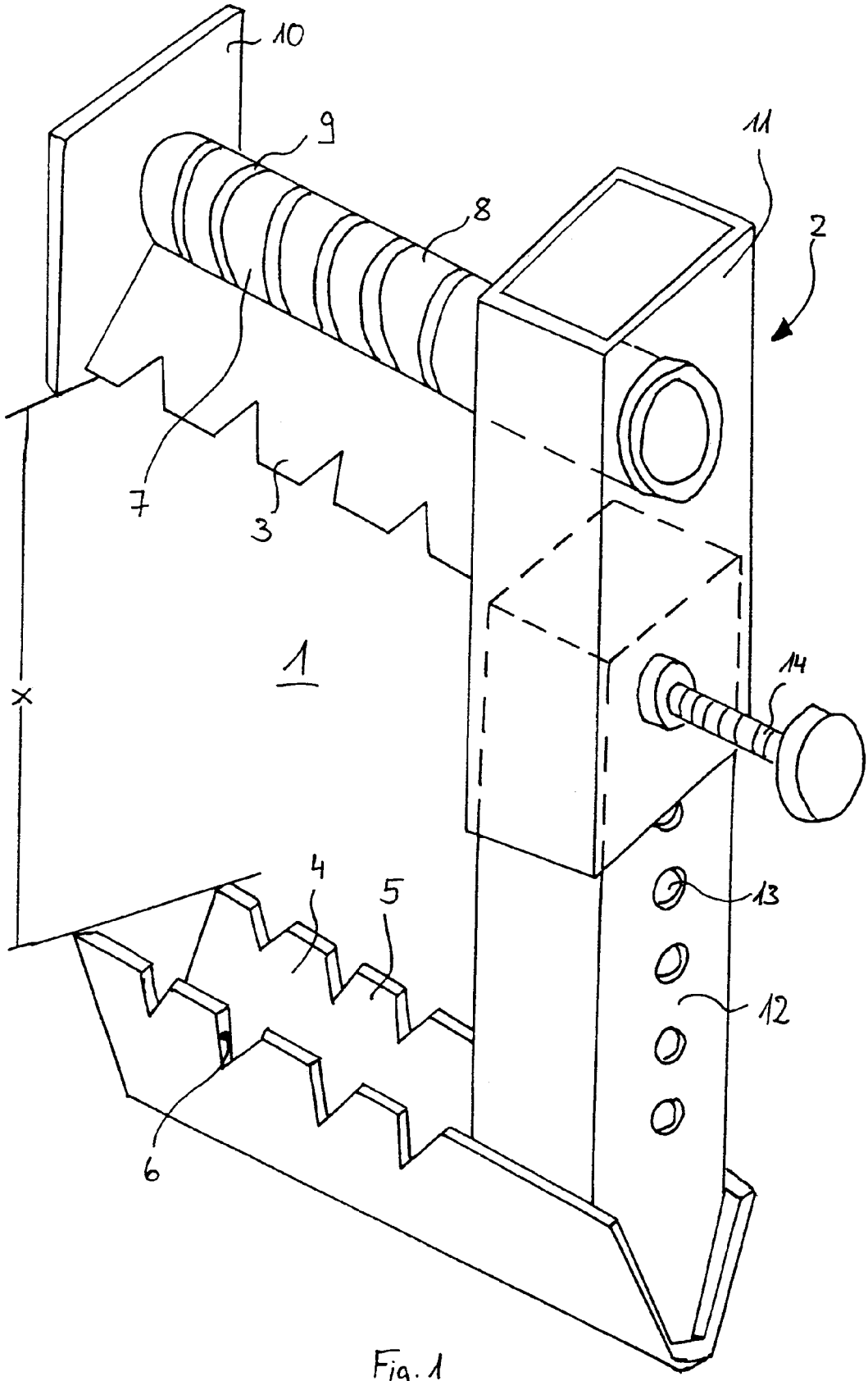
FIG. 1 shows a perspective representation of the support apparatus according to the invention.

Reference numeral 1 in FIG. 1 indicates the support apparatus according to the invention in its entirety. It consists of a frame 2 as well as an upper support claw 3 and a lower support claw 4, which together with the frame 2 form a C-shape.

The frame 2 includes a first frame part 11 as well as a second frame part 12, which can be slid against each other in the manner of a telescope in order to permit the opening width X of the support apparatus to be adjusted. Serving to fix the opening width are individual holes 13 inside the second frame part 12 as well as a fixing screw 14 provided on the first frame part 11, which screw, depending on the adjusted opening width, engages the pertinent hole 13 on the second frame part 12.

The upper support claw 3 as well as the lower support claw 4 are in each case formed as angled rails and display a toothing 6. The angled rails are here arranged such that their mouth in each case opens towards the opposing support claw 3 or 4, as the case may be. Each angled rail includes a narrow, edge-shaped bearing surface 15 [sic].

Provided in the region of the upper support claw 3 is a cross beam in the form of a pipe 8, which together with the upper support claw 3 forms a curved bearing surface 7 for the tool (not shown in FIG. 1) or rather the end piece of the latter. Provided in the pipe 8 are grooves 9 running in the direction transverse to the longitudinal course of the pipe 8, in order to make possible an additional fixing of the end piece (not shown in FIG. 1) of a spreading cylinder.

Figure 2:
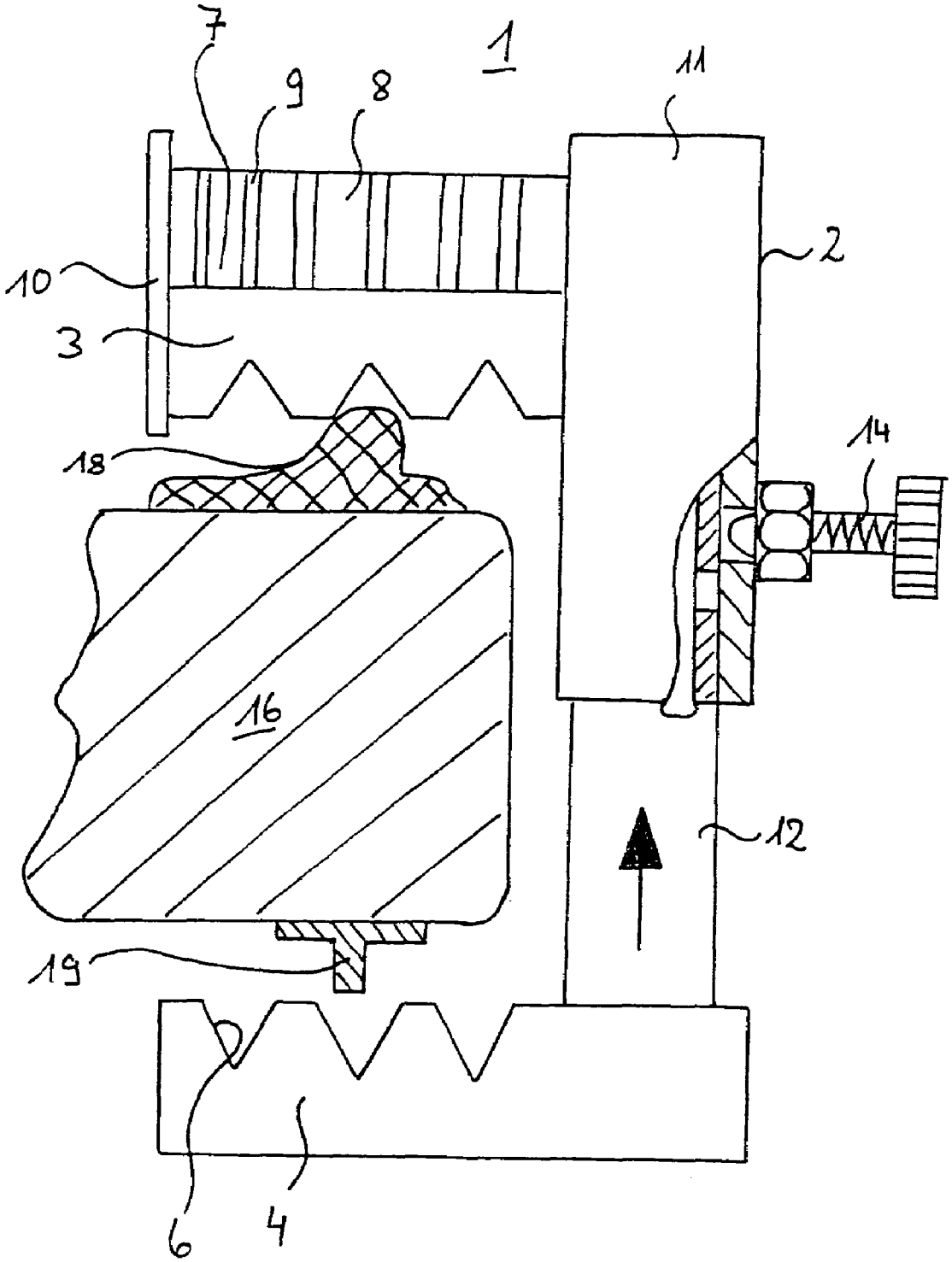
FIG. 2 shows a sectional representation of a door sill with a support apparatus according to the invention that has been attached but has not yet been placed in the operating position.
Figure 3:
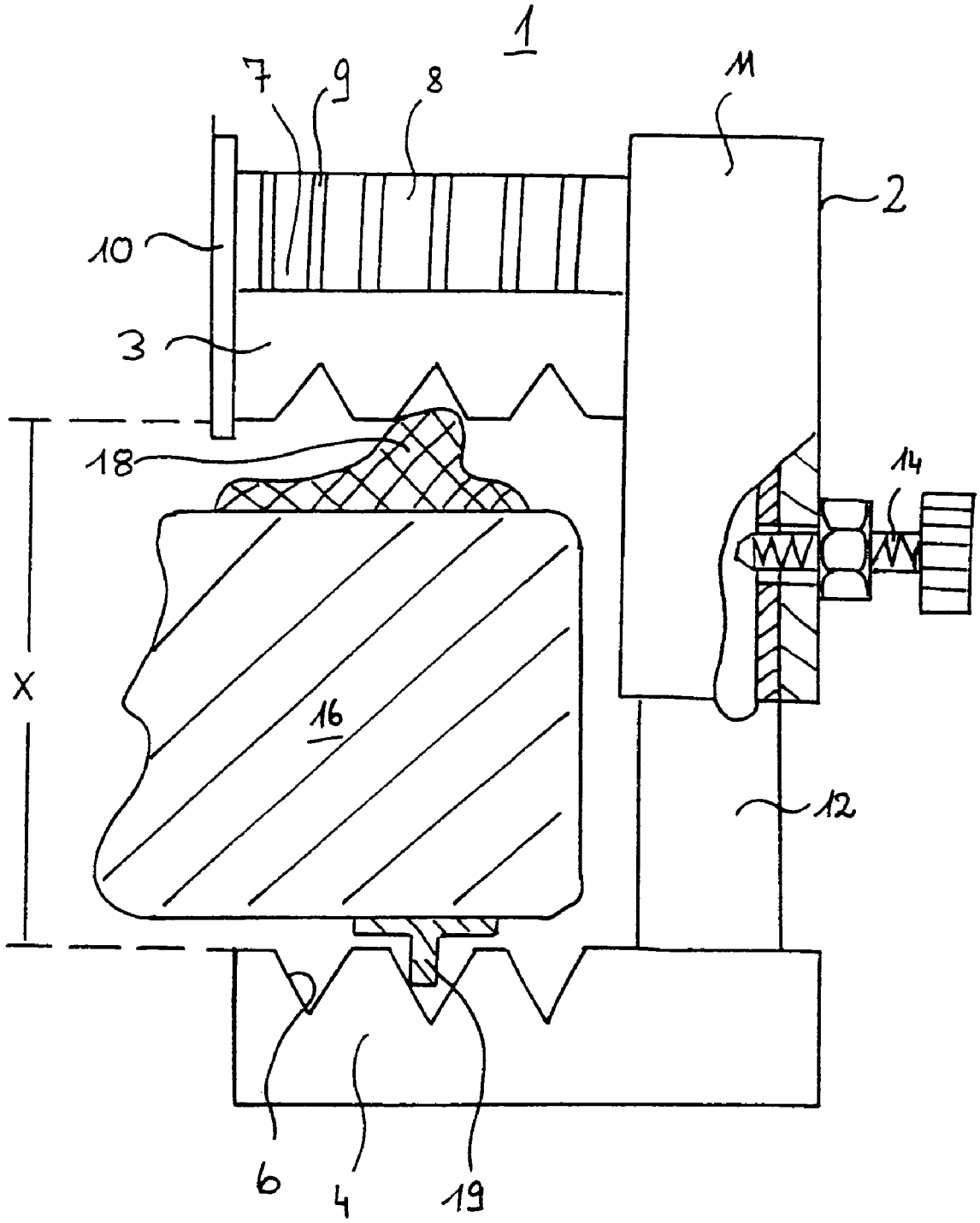
FIG. 3 shows a sectional representation of a door sill with a support apparatus according to the invention that has been attached and placed in the operating position.

The manner in which the support apparatus according to the invention is attached to the object is illustrated in FIGS. 2 and 3. Reference numeral 16 shows in cross section the sill of a vehicle door in sectional representation with a sealing profile 18 located on the top side and a T-support profile 19 located on the bottom side.

First, the support apparatus, with enlarged spacing between the two support claws 3, 4, is drawn over the sill 16 and then, according to FIG. 3, is brought into position, i.e. into contact with the sealing profile 18 and the T-support profile 19, through the sliding into each other of the first frame part 11 and the second frame part 12, and fixed in this position by means of the fixing screw 14. Here, the support apparatus 1 is merely fixed, i.e. no clamping, in other words tightening, of the support apparatus to the sill 16 takes place.

Figure 4:
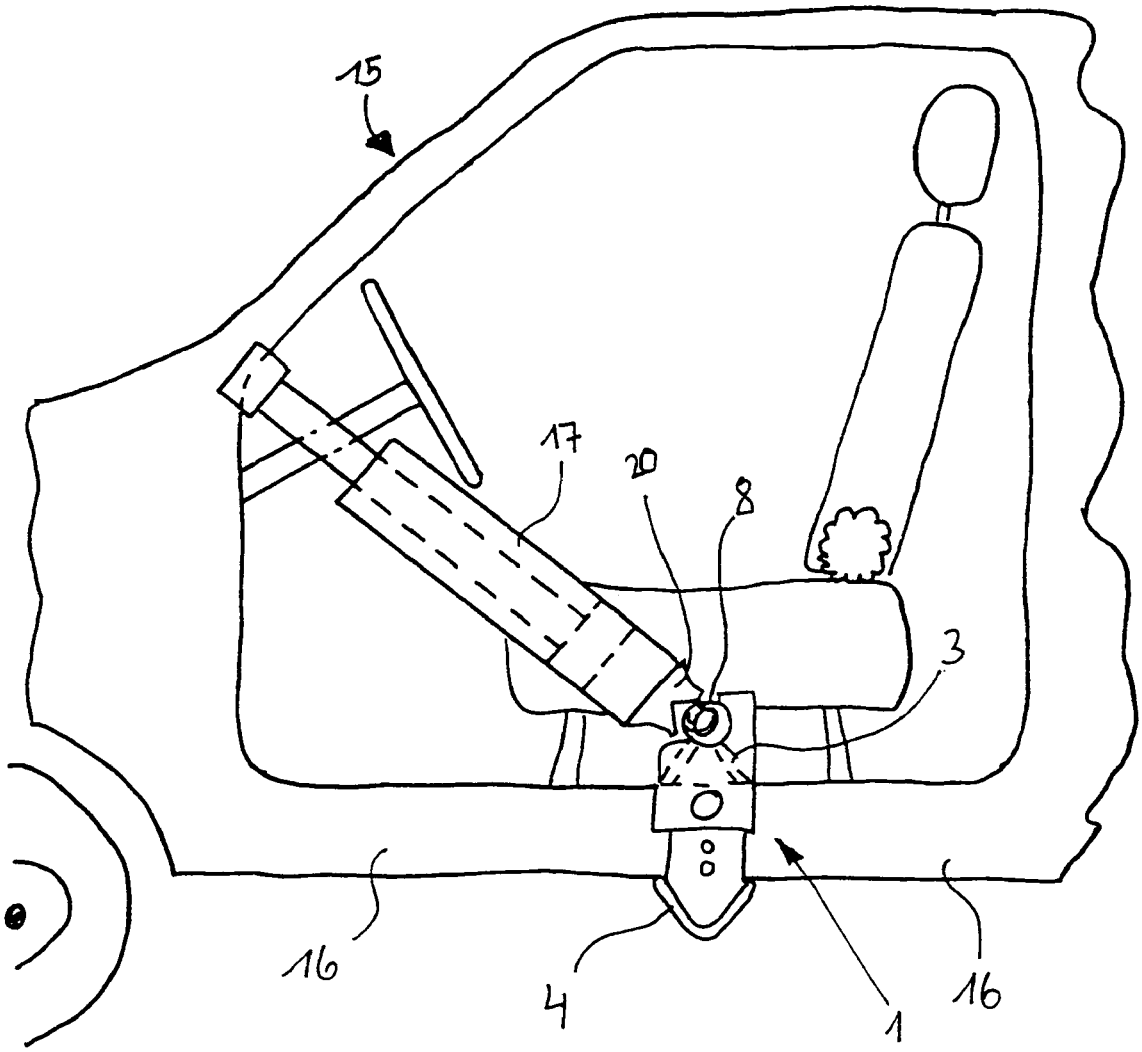
FIG. 4 shows a representation of the support apparatus according to the invention in the initial state before the loading by a spreading cylinder.

The position according to FIG. 3 is represented in FIG. 4 in an overall view involving the object in the form of a vehicle 15. In this position the spreading cylinder 17 engages with its end piece 20 the bearing region 7 of the pipe 8 of the support apparatus 1. At the opposite side of spreading cylinder 17, the latter rests against the frame of the window section of the vehicle 15.

The end piece 20 of the spreading cylinder 17 is here provided with a pointed recess, so that the outer surface of the pipe 8 engages the recess and a rotation of the angular position of the spreading cylinder 17 relative to the support apparatus 1 is possible.

Figure 5:
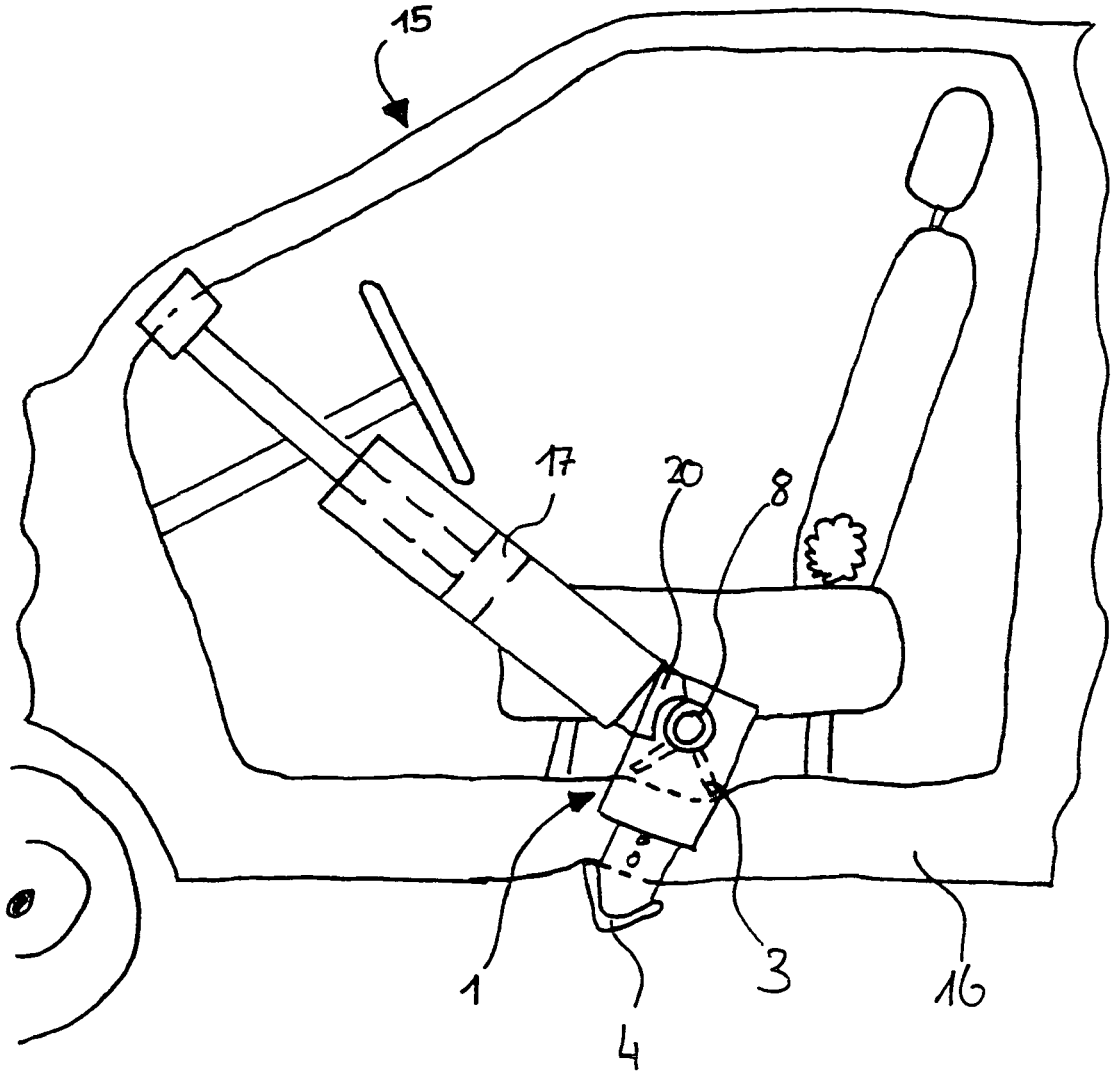
FIG. 5 shows a representation of the support apparatus according to the invention in the initial state during the loading by a spreading cylinder.

If now the ram of the spreading cylinder 17 is extended, the support apparatus 1 cants—as shown in FIG. 5 - and, through the two support claws 3, 4, causes a wedging and thus a holding effect of the support apparatus 1 on the sill 16. In this position, the support apparatus 1 acts as an effective counter bearing for the spreading cylinder 17 and makes possible a spreading out of the door section in the manner shown in FIG. 5.

The advantages of the support apparatus 1 according to the invention are that it is structurally very simple to produce, that it eliminates the need for a hydraulic cylinder or the like, and yet at the same time any position on the sill 16 can be chosen for attachment of the support apparatus 1. The support apparatus 1 according to the invention thus represents a quite special contribution to the relevant technological field.

REFERENCE NUMERAL LIST

1 support apparatus
2 frame
3 upper support claw
4 lower support claw
5 bearing surface
6 toothing
7 bearing region
8 pipe
9 groove
10 end plate
11 first frame part
12 second frame part
13 hole
14 fixing screw
15 vehicle
16 sill
17 spreading cylinder
18 sealing profile
19 t-support profile
20 end piece

The invention claimed is:

1. A support apparatus for supporting a tool on an object, the tool configured to provide a pushing force on the support apparatus when the tool is activated, said support apparatus comprising a frame and a retainer on the frame for retaining the support apparatus on the object, the tool being attached to the support apparatus and the support apparatus configured to be supported against the object without any clamping action when the tool is not activated, wherein the retainer comprises an upper and a lower support claw, the upper support claw defining a configuration with two rails spaced apart from each other, the rails of the upper support claw defining a first contact region spaced apart from a second contact region, the first contact region including two contacting edges and the second contact region including two contacting edges, the lower support claw defining a configuration with two rails spaced apart from each other, the rails of the lower support claw defining a third contact region spaced apart from a fourth contact region, the third contact region including two contacting edges and the fourth contact region including two contacting edges, the rails of the upper support claw defining a mouth that opens toward a mouth defined by the rails of the lower support claw, at least one of the first and second contact regions of the upper support claw configured to contact the object and at least one of the third and fourth contact regions of the lower support claw configured to contact the object, the first and second contact regions of the upper support claw and the third and fourth contact regions of the lower support claw being non-rotationally disposed with respect to the frame, wherein the claws are operable at a plurality of orientations with respect to the object and a curved bearing region for the tool, the bearing region being adjacent and and parallel to the upper support claw, the frame including the upper and the lower support claws forming a C-shape, wherein the upper and lower support claws are configured to cant with respect to a portion of the object located between the two support claws during the activation of the tool such that a clamping effect is caused by diametrically opposed contact regions of the upper and lower support claws on the object when the tool is activated.

2. The support apparatus according to claim 1, wherein at least one of the upper and the lower support claws includes teeth defined on the rails.

3. The support apparatus according to claim 1, wherein the contact regions of at least one of the upper and the lower support claws are disposed bilaterally with respect to the support apparatus.

4. The support apparatus according to claim 1, wherein the bearing region is formed through a cross strut, running parallel to the upper support claw.

5. The support apparatus according to claim 4, wherein the cross strut is a pipe or a bar.

6. The support apparatus according to claim 4, wherein the cross strut includes grooves.

7. The support apparatus according to claim 4, wherein the cross strut and the upper support claw lie against a common end plate.

8. The support apparatus according to claim 1, wherein the spacing between the two support claws is adjustable.

9. The support apparatus according to claim 8, wherein the frame displays a first frame part as well as a second frame part, and the first frame part and the second frame part are slidable, yet fixable, relative to each other.

10. The support apparatus according to claim 9, wherein holes and a fixing screw or a stop bolt are provided for the fixing of the two frame parts.

11. The support apparatus according to claim 1, wherein the tool includes an end piece corresponding to the shape of the bearing region.

12. A support apparatus for supporting a tool on an object, said support apparatus comprising a frame and a retainer on the frame for retaining the support apparatus on the object, the tool being attached to the support apparatus and the support apparatus being supported against the object, wherein retainer comprises an upper and a lower support claw, wherein the claws are operable at a plurality of orientations with respect to the object and a tool engaging surface for engaging the tool surface on the upper claw, wherein the tool engaging surface being a bearing region formed through a cross strut, running parallel to the upper support claw, wherein the cross strut is a pipe or a bar, the frame including the upper and the lower support claws forms a C-shape, the upper and lower support claws are configured to cant during loading of the support apparatus with respect to a portion of the object located between the two support claws to hold the support apparatus.

13. A support apparatus for supporting a tool on an object, said support apparatus comprising a frame and a retainer on the frame for retaining the support apparatus on the object, the tool being attached to the support apparatus and the support apparatus being supported against the object, wherein retainer comprises an upper and a lower support claw, wherein the claws are operable at a plurality of orientations with respect to the object and a tool engaging surface for engaging the tool surface on the upper claw, wherein the tool engaging surface being a bearing region formed through a cross strut, running parallel to the upper support claw, wherein the cross strut includes grooves, the frame including the upper and the lower support claws forms a C-shape, the upper and lower support claws are configured to cant during loading of the support apparatus with respect to a portion of the object located between the two support claws to hold the support apparatus.

14. An apparatus comprising:

a support apparatus for supporting a tool on an object, the support apparatus including a frame and a retainer on the frame for retaining the support apparatus on the object, the retainer including an upper and a lower support claw, the upper support claw defining a configuration with two rails spaced apart from each other, the rails of the upper support claw defining a first contact region spaced apart from a second contact region configured to contact the object, the first contact region including two contacting edges and the second contact region including two contacting edges, the lower support claw defining a configuration with two rails spaced apart from each other, the rails of the lower support claw defining third contact region spaced apart from a fourth contact region configured to contact the object, the third contact region including two contacting edges and the fourth contact region including two contacting edges, the rails of the upper support claw defining a mouth that opens toward a mouth defined by the rails of the lower support claw, the contact regions of the upper and lower support claws being non-rotationally disposed with respect to the frame, the retainer further including a curved bearing region for the tool, the bearing region being adjacent and parallel to the upper support claw, the frame including the upper and the lower support claws forming a C-shape; and the tool operably coupled to the support apparatus, the tool configured to be operable between an activated position and a non-activated position, wherein the support apparatus is configured to be supported against the object without any clamping action when the tool is not activated and wherein the tool is configured to provide a pushing force on the support apparatus when the tool is activated such that the upper and lower support claws are configured to cant with respect to a portion of the object located between the two support claws and cause a clamping effect of the upper and lower support claws on the object.

* * * * *